US008528351B2

(12) United States Patent
An et al.

(10) Patent No.: US 8,528,351 B2
(45) Date of Patent: Sep. 10, 2013

(54) ICE MAKER AND REFRIGERATOR HAVING THE SAME

(75) Inventors: Si Yeon An, Seoul (KR); Seong Jae Kim, Seoul (KR); Dong Hoon Lee, Seoul (KR); Ii Wook Joung, Seoul (KR)

(73) Assignee: LG Electronics Inc., Seoul (KR)

( * ) Notice: Subject to any disclaimer, the term of this patent is extended or adjusted under 35 U.S.C. 154(b) by 660 days.

(21) Appl. No.: 12/863,022

(22) PCT Filed: Oct. 17, 2008

(86) PCT No.: PCT/KR2008/006132

§ 371 (c)(1),
(2), (4) Date: Jul. 15, 2010

(87) PCT Pub. No.: WO2009/091112

PCT Pub. Date: Jul. 23, 2009

(65) Prior Publication Data

US 2011/0048045 A1 Mar. 3, 2011

(30) Foreign Application Priority Data

Jan. 17, 2008 (KR) ..... 10-2008-0005294

(51) Int. Cl.
*F25C 1/00* (2006.01)
*F25C 5/18* (2006.01)

(52) U.S. Cl.
USPC ..... 62/137; 62/135; 62/344

(58) Field of Classification Search
USPC ..... 62/137, 347, 441, 344, 259.1, 135
See application file for complete search history.

(56) References Cited

U.S. PATENT DOCUMENTS

| | | | | |
|---|---|---|---|---|
| 4,852,359 | A | 8/1989 | Manzotti | 62/68 |
| 6,041,607 | A | 3/2000 | Kim | 62/188 |
| 2006/0090485 | A1 | 5/2006 | Lee et al. | 62/135 |

FOREIGN PATENT DOCUMENTS

| | | | |
|---|---|---|---|
| CN | 1205420 | A | 1/1999 |
| CN | 1769820 | A | 5/2006 |

OTHER PUBLICATIONS

Chinese Office Action dated Nov. 9, 2011 issued in Application No. 200880125053.9 (with translation).
PCT International Search Report and Written Opinion dated May 24, 2010 issued in Application No. PCT/KR2008/006132.

*Primary Examiner* — Chen Wen Jiang
(74) *Attorney, Agent, or Firm* — KED & Associates LLP

(57) ABSTRACT

An ice maker comprises a tray accommodating water to make ice, a first control box (200) installed at a side of the tray, the first control box (200) accommodating a predetermined part of a mechanism unit driving the ice maker; and a second control box (300) accommodating the other part of the mechanism unit which is electrically connected with the part of the mechanism unit accommodated in the first control part.

18 Claims, 3 Drawing Sheets

ICE MAKER AND REFRIGERATOR HAVING THE SAME

TECHNICAL FIELD

The present invention relates to an ice maker and a refrigerator having the same. More specifically, the present invention relates to an ice maker capable of preventing ice from being stuck while ejecting ice, with an increased amount of ice.

BACKGROUND ART

An ice maker is a kind of a device mounted in a freezing apparatus to make ice by using cold air. Typically, water is held in a predetermined container of refrigerators, water purifiers, vending machines, ice making devices and variations of them (hereinafter, refrigerators), and then the water is frozen at temperatures below freezing to make ice.

Ice is made in a simple method according to a conventional ice maker. That is, a tray holding water is put in a freezing compartment of which the temperature is below freezing to make ice. However, with improvement of standard of living and development of technology, a new system has been developed in that ice making and ejecting is performed automatically without help of human's hands.

Recently has been released an ice maker which is capable of supplying water to a tray automatically to make the water ice and which includes a heating device installed adjacent to the tray to heat the tray such that the ice may be ejected.

The amount of the ice which is producible per the unit time is determined the number of cells provided in the tray. The cell is a predetermined space partitioned in the tray to accommodate water.

DISCLOSURE OF INVENTION

Technical Problem

However, if the conventional ice maker is provided in the refrigerator, the size of the ice maker is limited and the number of the cells is also limited.

Accordingly have been increasing demands of a structure capable of increasing the number of the cells provided in the ice maker. Together with the increased number of the cells, guiding means capable of guiding ejected ice to prevent the ice stuck because of the space limit.

Technical Solution

To solve the problems, an ice maker includes a tray accommodating water to make ice; a first control box installed at a side of the tray, the first control box accommodating a predetermined part of a mechanism unit driving the ice maker; and a second control box accommodating the other part of the mechanism unit which is electrically connected with the part of the mechanism unit accommodated in the first control part.

The second control box may be installed outside an ice-making chamber accommodating the ice maker.

The second control box may be provided on or under the tray.

The second control box may be detachably coupled to an upper portion of the first control box.

The mechanism unit may include a driving assembly relating to operations of an ejector ejecting ice out of the tray and an ice amount sensing lever sensing the ice amount; a first circuit board on which electric parts controlling an operation of the driving assembly are mounted; and a second circuit board on which electric parts controlling an overall operation of the ice maker except the operation of the driving assembly are mounted.

The driving assembly and the first circuit board may be accommodated in the first control box.

The second circuit board may be accommodated in the second control box.

A wire communication hole may be formed at the first control box and the second control box for a wire electrically connecting the mechanism unit of the first control box with the mechanism unit of the second control box to pass through.

The ice maker may further include an ejecting guide preventing the ice from being stuck in the second control box, when the ice is ejected from the tray.

The try may include a vertical extension preventing the water from overflowing the tray.

The ejecting guide may be coupled to an upper portion of the vertical extension.

The ice maker may further include a water supply part installed adjacent to the ejecting guide to supply water to the tray.

The water supplied from the water supply part may be drawn into the tray via a path formed at the ejecting guide.

An inner surface of the ejecting guide may have a gentle curvature.

In another aspect, a refrigerator includes a body comprising a refrigerating compartment and a freezing compartment; an least one ice-making chamber provided in at least one of the refrigerating compartment, the freezing compartment and doors opening and closing the refrigerating and freezing compartments; and an ice maker provided in the ice-making chamber. Here, the ice maker includes a tray accommodating water to make ice; a first control box installed at a side of the tray, the first control box accommodating a predetermined part of a mechanism unit driving the ice maker; and a second control box accommodating the other part of the mechanism unit which is electrically connected with the part of the mechanism unit accommodated in the first control part.

The refrigerating compartment may be provided in a lower portion of the body and the ice-making chamber may be provided in an inner side surface of the door selectively opening and closing the refrigerating compartment.

The second control box may be coupled to an upper portion of the first control box.

The refrigerator may further include an ejecting guide provided beyond the tray to guide the ice ejected out of the tray, an inner surface of the ejecting guide having a gentle curvature.

Advantageous Effects

The present invention has following advantageous effects.

According to an ice maker according to an exemplary embodiment, a mechanism unit relating an operation of the ice maker is accommodated in two control boxes dividedly. This is more advantageous in the matter of space utilization, compared with a conventional ice maker including a whole mechanism unit accommodated in a single control box.

Furthermore, the length of a tray provided in the ice maker and the number of cells provided in the tray may be increased. As a result, the amount of the ice made per the unit time also may be increased.

Still further, an ejecting guide is provided in the ice maker according to the exemplary embodiment. As a result, even when a control box is provided above the tray, ice may be prevented from being stuck during the ejecting of the ice.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
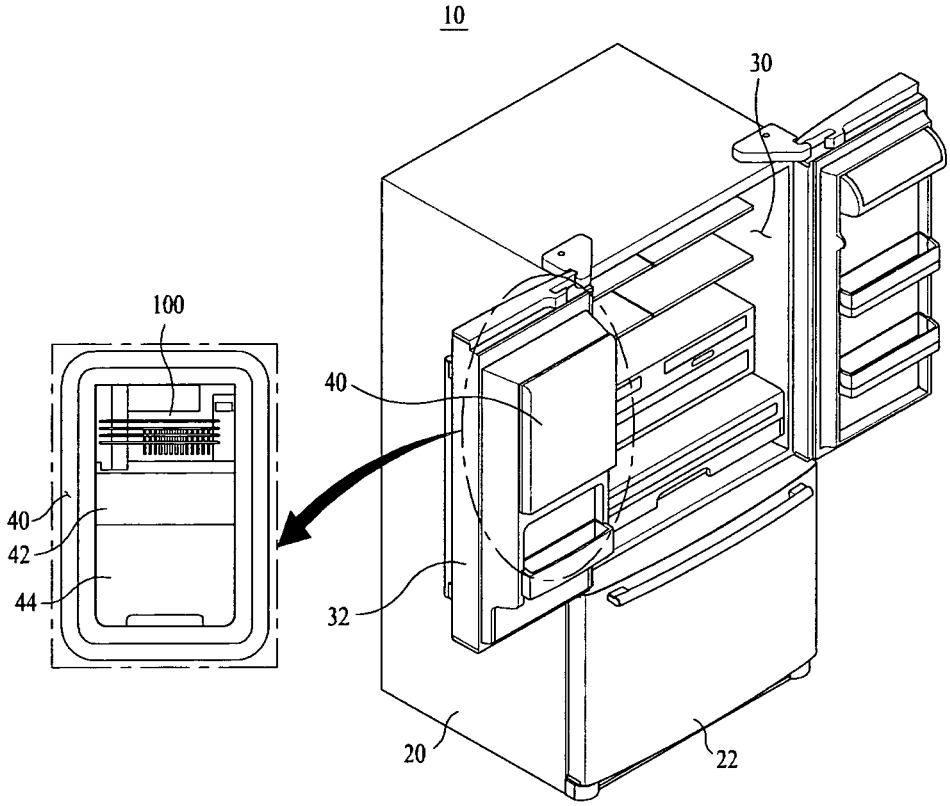
FIG. 1 is a perspective view illustrating an ice maker according to an exemplary embodiment, which is mounted at a door of a refrigerator.

FIG. 1 is a perspective view illustrating an ice maker according to an exemplary embodiment which is mounted at a door of a refrigerant.

In reference to FIG. 1, an ice maker 100 according to the exemplary embodiment may be installable to a water purifier, vending machine and e.g. and this embodiment presents that the ice maker 100 is installed in a refrigerator 10.

The refrigerator 10 includes a freezing compartment 20 and a refrigerating compartment 30 which store food items, respectively. Doors 22 and 32 are coupled to fronts of the freezing and refrigerating compartments to open and close the freezing and refrigerating compartments, respectively. This embodiment presents a bottom freezing type refrigerator having the freezing compartment 20 positioned under the refrigerating compartment 30 and this embodiment may be applicable to other various types of refrigerators.

Two doors 32 of the refrigerating compartment 30 are hinge-coupled to opposite sides of a refrigerator body to be closable in a right-and-left direction and a single door 22 of the freezing compartment 20 is coupled to the body to be able to slide in a forward-and-backward direction with respect to the refrigerator body.

Here, the door 22 of the freezing compartment 20 and the doors 32 of the refrigerating compartment 30 may be positioned variably according to the positions of the refrigerating and freezing compartments. For example, this embodiment may be applicable to a top-mount type, a side-by-side type and variations of them.

An ice-making chamber 40 may be provided in one of the two refrigerating compartment doors 32. A predetermined airtight space surrounded by a frame may be formed at a rear surface of the refrigerating compartment door 32 and the ice-making chamber 40 may be formed in the space. It is preferable that the ice-making chamber 40 is heat-insulated not to heat-exchange with the refrigerating compartment 30, because the ice-making chamber 40 is adjacent to the refrigerating compartment 30.

Of course, it is possible to form the ice-making chamber 40 within the freezing compartment 20 or the refrigerating compartment 30. Considering user access convenience and utilization efficiency of inner space of the refrigerator, it is preferable that the ice-making chamber 40 is provided at the door 32 of the refrigerating compartment 30.

An ice maker 100 is provided in the ice-making chamber 40. An ice bank 42 and a dispenser 44 are provided under the ice maker 100. Ice is stored in the ice bank 42 temporarily and the ice is discharged via the dispenser 44 according to the user request.

Figure 2:
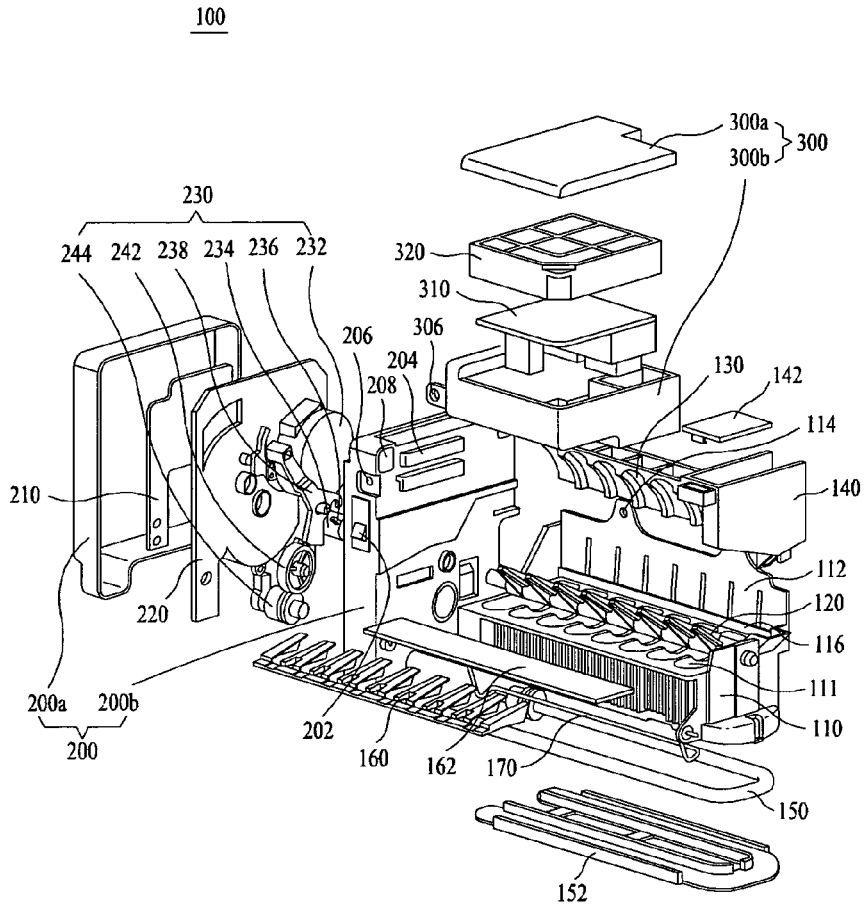
FIG. 2 is an exploded perspective view of the ice maker according to the embodiment.
Figure 3:
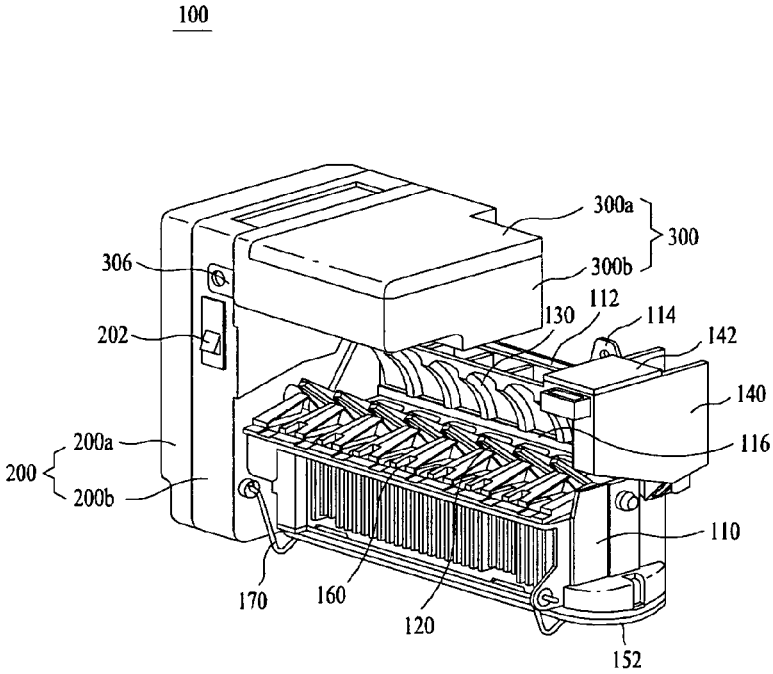
FIG. 3 is a perspective view of the ice maker.
Figure 4:
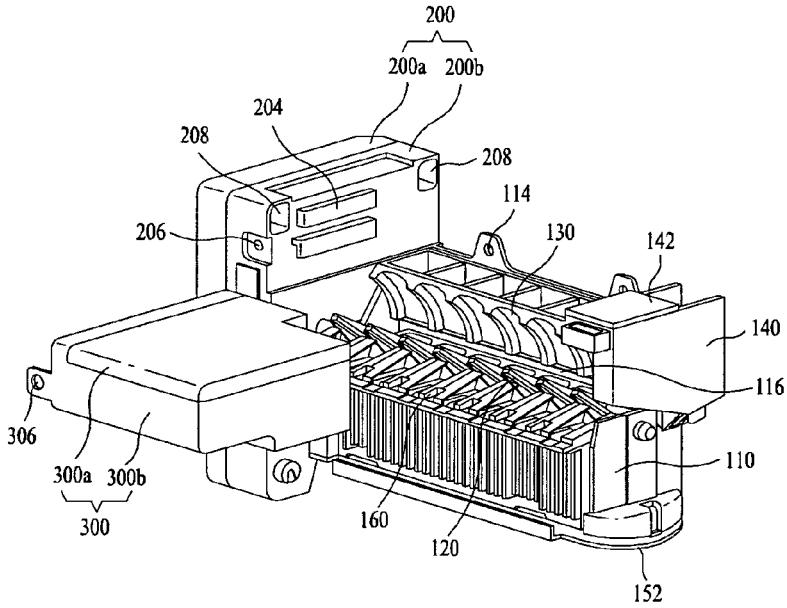
FIG. 4 is a perspective view of the ice maker, in case that a second control box of the ice maker is separated from a first control box.

FIG. 2 is an exploded perspective view of the ice maker according to the embodiment. FIG. 3 is a perspective view of the ice maker. FIG. 4 is a perspective view illustrating the ice maker, if a second control box of the ice maker is separated from a first control box.

In reference to FIGS. 2 to 4, the ice maker 100 according to the exemplary embodiment includes a tray 110, a first control box 200 and a second control box 300. The tray 110 accommodates water to make ice. The first control box 200 installed at a side of the tray 110 may accommodate some parts of a mechanism unit driving the ice maker 100 and the second control box 300 may accommodate the other parts of the mechanism unit electrically connected with the part of the mechanism unit accommodated by the first control box 200.

A predetermined space is formed in the tray 110 and water is held in the space to make ice. Specifically, the tray includes at least one cell 111 accommodating the water to make ice and an opening is formed at a top of the cell 111. Thus, the water is supplied via the opening and the ice is separated from the tray via the opening. The tray 1110 may be an aggregate of the plural cells 111.

The cell may be formed in various shapes and this embodiment presents a hemisphere shaped cell, considering simplicity of ice ejecting.

A support 112 may be provided at a rear of the tray 110 to secure the ice maker 100 to the ice-making chamber 40. A fastening hole 114 may be formed at an upper portion of the support 112 and the support 112 may be fastened to the ice-making chamber 40 through the fastening hole 114 by a bolt, for example.

An ejector 120 is provided in the ice maker 100 to eject the ice, once ice is made. The ejector 120 is provided along a longitudinal direction of the tray 110 and here the longitudinal direction means a direction in which the cells 111 stands in line. As the ejector 120 rotates, the ice is pushed upward to be ejected out of the tray 110.

A heater 150 may be provided under the tray 110 to melt the ice partially and then to separate the ice from the tray 110. The heater 150 may be mounted at a predetermined portion provided under the tray 110 and it is separated from the outside by a heat cover 152.

A discharge guide 160 may be provided at a front of the tray 110 to guide the ice ejected out of the tray 110 toward the ice bank (42, see FIG. 1). The discharge guide 160 has an oblique inclined downward to the tray 110 and it guides the ice to be dropped to the ice bank 42.

The discharge guide 160 is secured to a discharge guide support 162 and the discharge guide support 162 is secured to the front of the tray 110, such that the discharge guide 160 may be secured to the tray 110.

An ice amount sensing lever 170 may be provided at a lower front of the tray 110 to sense if the amount of ice within the tray 110 is full enough. The position of the ice amount sensing lever 170 may be changeable according to the amount of the ice accommodated in the tray 110 and a hall sensor (not shown) provided in the control box, which will be described later, senses position changes of the ice amount sensing lever 170 to sense the amount of the ice inside the ice bank 42.

As mentioned above, the first control box 200 may be coupled to the side of the tray 110 and it accommodates some parts of the mechanism unit driving the ice maker. Specifically, the first control box 200 is configured of a first case 200*a* and a second case 200*b* coupled to the first case 200*a* to form a predetermined space. The first control box 200 may be provided in a longitudinal direction of the tray 110 and a switch 202 is provided at the first control box 200 to switch on and off the ice maker 100.

Here, the mechanism unit may include a driving assembly 230, a first circuit board 210 and a second circuit board 310. The driving assembly 230 relates to the operations of the ejector 120 ejecting the ice and the ice amount sensing lever 170 sensing the ice amount. On the first circuit board 210 are mounted electric parts controlling the operation of the driving assembly 230 and on the second circuit board 310 are mounted electric parts controlling an overall operation of the ice maker 100 except the operation of the driving assembly 230.

It is preferable that the driving assembly 230 is provided in the first control box 200 provided along the longitudinal direction of the tray 110, because a rotation shaft relating the motion of the ejector 120 and the ice amount sensing lever 170 is also provided in the longitudinal direction. Here, a middle panel 220 may be provided in the first control box 200 and the driving assembly 230 is secured to the inner portion of the first control box 200 by the middle panel 220.

Next, the structure of the driving assembly 230 will be described.

First of all, a motor 232 is provided in the driving assembly 230 to transmit a driving force to the ejector 120 and the ice amount sensing lever 170. Furthermore, an ejector driving shaft 234 is rotated by the motor 232 to rotate the ejector 120. As the ejector driving shaft 234 is rotating, the ejector 120 is rotating together such that the ice is ejected out of the tray 110.

An arm lever 238 is provided in the driving assembly 230 and the arm lever 238 transmits the rotational force of the ejector driving shaft 234 to the ice amount sensing lever 170, such that the ice amount sensing lever 170 may reciprocate. The arm lever 238 receives the force from a cam 236 provided to drive the arm lever 238 whenever the ejector driving shaft 234 makes one rotation.

At this time, an ice amount sensing lever driving shaft 244 is further provided to drive the ice amount sensing lever 170 and the ice amount sensing lever driving shaft 244 is rotated by a driven gear 242 transmitting the rotational force of the arm lever 238 to the ice amount sensing lever driving shaft 244. The ice sensing lever 170 reciprocates with a trace of circular arcs with respect to the ice amount sensing lever driving shaft 244.

The ejector 120 is rotated by the driving assembly 230 to eject the ice out of the tray 110. At this time, the ice amount sensing lever 170 reciprocates, that is, rotates about the ice amount sensing lever driving shaft 244 repeatedly. Specifically, the ice amount sensing lever 170 rotates upward and rotates downward again to be positioned above the ice bank 42 such that the ice amount may be sensed.

The structure of the driving assembly 230 is not limited as described above and it may be variable according to the configuration of the ice maker 100.

In the meantime, the first circuit board 210 and the second circuit board 310 may be configured of printed wiring boards (PWB) which can be called as printed circuit boards (PCB). PWB or PCB is a circuit board on which electric parts are mounted to electrically connect among parts or signal wires.

As mentioned above, the electric parts controlling the operation of the driving assembly 230 are mounted on the first circuit board 210 and the electric parts controlling the overall operation of the ice maker 100, except the driving assembly 230, are mounted on the second circuit board 310.

The ice maker 100 further includes the second control box 300 which accommodates the other parts of the mechanism unit electrically connected with the parts of the mechanism unit accommodated by the first control box 200. The second control box 300 includes a third case 300*a* and a fourth case 300*b* coupled to the third case 300*a* to form a predetermined space.

As shown in FIG. 2, the driving assembly 230 and the first circuit board 210 of the mechanism unit may be accommodated by the first control box 200. If then, the second circuit board 310 may be accommodated by the second control box 300.

Although not shown in the drawings, the first and second circuit boards 210 and 310 of the mechanism unit may be accommodated by the second control box 300. In this case, the driving assembly 230 may be accommodated by the first control box 200.

In any cases, the mechanism unit accommodated by the first control box 200 should be electrically connected with the mechanism unit accommodated by the second control box 300 to control the operation of the ice maker 100.

Furthermore, a protection panel 320 is provided to project the mechanism unit accommodated by the second control box 300.

Here, wire communication holes 208 may be provided at the first and second control boxes 200 and 300 and wires pass through the wire communication holes 208 to electrically connect the first control box 200 with the second control box 300. Although the first and second circuit boards 210 and 310 and the driving assembly 230 are provided in the first and second control boxes 200 and 300 dividedly, the circuit boards 210 and 310 can be electrically connected with the driving assembly 230 via the wire communication holes 208.

Alternatively, the second control box 300 may be separately installed outside the ice-making chamber 40 accommodating the ice maker 100 and it may be provided above or below the tray 110.

As shown in FIGS. 2 to 4, it is preferable that the second control box 300 is detachably coupled to an upper portion of the first control box 200. Specifically, at least one coupling guide 204 may be provided to guide the second control box 300 coupled to the upper portion of the first control box 200. At this time, a projection (not shown) provided at the second control box 300 is guided between the coupling guides 204 in a forward and backward direction of the ice maker 100 such that the second control box 300 may be coupled to or separated from the first control box 200.

A first control box coupling hole 206 is provided at the first control box 200 and a second control box coupling hole 306 is provided at the second control box 300. As a result, after the first control box 200 is coupled to the second control box 300, the two control boxes 200 and 300 may be fastened by a bolt via the control box coupling holes.

It may be more advantageous in the matter of space utilization to accommodate the mechanism unit in the first and second control boxes 200 and 300 dividedly, than to accommodate the whole mechanism unit in a single control box.

If the single control box accommodating the whole mechanism unit is provided at the side of the tray 110, useable space in a longitudinal direction of the tray 110 is insufficient and the length of the tray is short accordingly, considering that the ice maker 100 is installed within the ice-making chamber 40. As a result, the number of the cells 111 of the tray 110 should be reduced and the amount of the ice made per unit time could be reduced.

In contrast, according to this embodiment, only the part of the mechanism unit which should be provided at the side of the tray 110 in the longitudinal direction of the tray 110, for example, the driving assembly 230 is accommodated in the first control box 200 and the other part of the mechanism unit is accommodated in the second control box 300 and then the second control box 300 is installed in the predetermined portion with enough space. As a result, this embodiment may have an advantage in that the length of the tray 110 is increased.

The number of the cells 111 provided in the tray 110 may be increased, which will increase the amount of the ice per the unit time. It may be identified substantially that the ice amount made per day in the ice maker 100 according to the embodiment is increased by 25%, compared with the ice amount made per day in the conventional ice maker.

In case that the second control box 300 coupled to the upper portion of the first control box 200 to be positioned above the tray 110, the ejected ice might be stuck in the second control box 300.

If the ice is ejected out of the tray 110 in the ice maker 100 according to the exemplary embodiment, an ejecting guide 130 may be further provided beyond the tray 110 to guide the ice not as to be stuck at the second control box 300.

It is preferable that the ejecting guide 130 is formed in a shape corresponding to a trace of the ejected ice, to prevent the ice from being stuck in the second control box 300.

As mentioned above, an inner surface shape of the cell is a concave hemisphere. If the ice is formed in a hemisphere shape, it is preferable that the inner surface of the ejecting guide 130 has a gentle curvature to eject the ice from the cell 111 with gently tracing circular arcs.

A vertical extension 116 may be further provided to prevent the water from overflowing the tray 110. In this case, the ejecting guide 130 may be coupled to an upper portion of the vertical extension 116 and it is preferable that the vertical extension 116 is approximately 10 mm in height.

A water supply part 140 may be further provided at a predetermined portion of the ejecting guide 130 to supply water to the tray 110. A water supply part cover 142 is coupled to an upper portion of the water supply part 140.

Here, the water supplied from the water supply part 140 may be supplied to each of the cells 111 via a path (not shown) formed at the ejecting guide 130.

Figure 5:
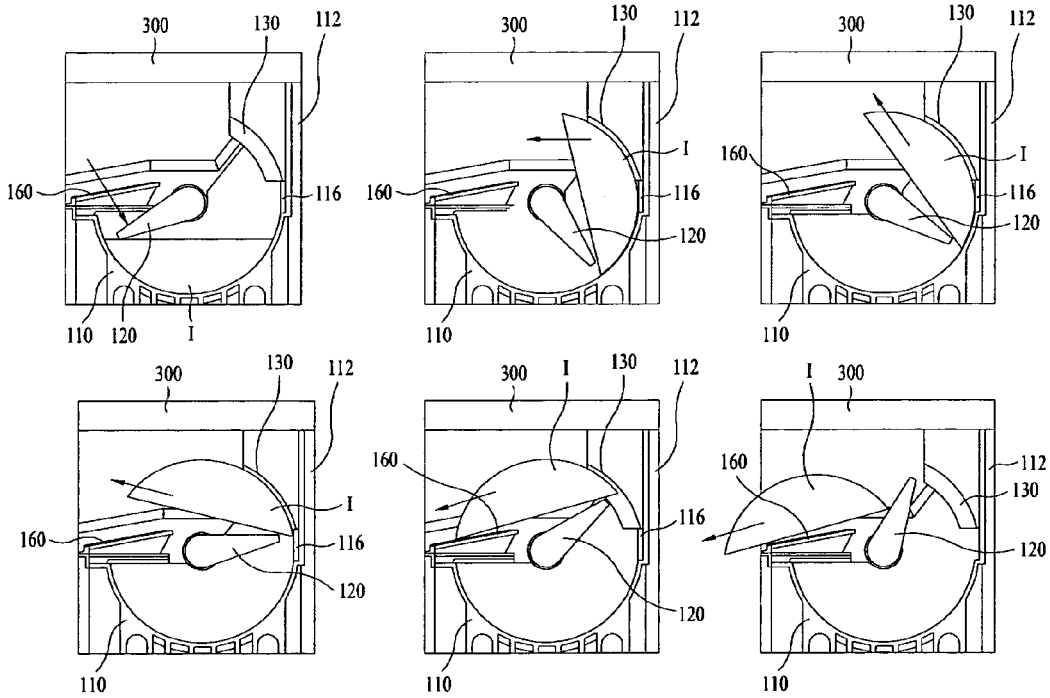
FIG. 5 is a side view of the ice maker, in case that ice is ejected from a tray provided in the ice maker.

FIG. 5 is a diagram illustrating a side of the ice maker according to the exemplary embodiment, if ice is ejected from the tray.

In reference to FIG. 5, once ice is made, the heater 150 is operated to melt some surface of ice in close contact with the tray 110. As the motor 232 is operated and the ejector 120 is rotated, the ice is moved.

With the rotation of the ejector 120, the ice moves to the rear of the tray 110, with a trace of circular arcs, and the ice moves to the front of the tray 110 by the counteraction of the ejecting guide 130 again.

Hence, the ice supported by the ejector may move forward to contact with a top of the ejecting guide 160 and the ice may move downward along the oblique of the ejecting guide 160, such that the ice is ejected out of the tray 110.

At this time, during the ice ejecting, the ejecting guide 130 guides the ice moving upward to be discharged gently and smoothly, without contacting with or being stuck at the second control box 300.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. An ice maker comprising:

a tray accommodating water to make ice;

a first control box installed at a side of the tray, the first control box accommodating a predetermined part of a mechanism unit driving the ice maker; and a second control box accommodating the other part of the mechanism unit which is electrically connected with the part of the mechanism unit accommodated in the first control part.

2. The ice maker as claimed in claim 1, wherein the second control box is installed outside an ice-making chamber accommodating the ice maker.

3. The ice maker as claimed in claim 1, wherein the second control box is provided above or below the tray.

4. The ice maker as claimed in claim 3, wherein the second control box is detachably coupled to an upper portion of the first control box.

5. The ice maker as claimed in claim 4, wherein the mechanism unit comprises, a driving assembly relating to operations of an ejector ejecting ice out of the tray and an ice amount sensing lever sensing the ice amount;

a first circuit board on which electric parts controlling an operation of the driving assembly are mounted; and a second circuit board on which electric parts controlling an overall operation of the ice maker except the operation of the driving assembly are mounted.

6. The ice maker as claimed in claim 5, wherein the driving assembly and the first circuit board are accommodated in the first control box.

7. The ice maker as claimed in claim 5, wherein the second circuit board is accommodated in the second control box.

8. The ice maker as claimed in claim 5, wherein a wire communication hole is formed at the first control box and the second control box for a wire electrically connecting the mechanism unit of the first control box with the mechanism unit of the second control box to pass through.

9. The ice maker as claimed in claim 4, further comprising:

an ejecting guide preventing the ice from being stuck at the second control box, when the ice is ejected from the tray.

10. The ice maker as claimed in claim 9, wherein the try comprises a vertical extension preventing the water from overflowing the tray.

11. The ice maker as claimed in claim 10, wherein the ejecting guide is coupled to an upper portion of the vertical extension.

12. The ice maker as claimed in claim 9, further comprising a water supply part installed adjacent to the ejecting guide to supply water to the tray.

13. The ice maker as claimed in claim 12, wherein the water supplied from the water supply part is drawn into the tray via a path formed at the ejecting guide.

14. The ice maker as claimed in claim 9, wherein an inner surface of the ejecting guide has a gentle curvature.

15. A refrigerator comprising:

a body comprising a refrigerating compartment and a freezing compartment;

an least one ice-making chamber provided in at least one of the refrigerating compartment, the freezing compartment and doors opening and closing the refrigerating and freezing compartments; and an ice maker provided in the ice-making chamber, the ice maker comprising:

a tray accommodating water to make ice;

a first control box installed at a side of the tray, the first control box accommodating a predetermined part of a mechanism unit driving the ice maker; and a second control box accommodating the other part of the mechanism unit which is electrically connected with the part of the mechanism unit accommodated in the first control part.

16. The refrigerator as claimed in claim 15, wherein the refrigerating compartment is provided in a lower portion of the body and the ice-making chamber is provided in an inner side surface of the door selectively opening and closing the refrigerating compartment.

17. The refrigerator as claimed in claim 16, wherein the second control box is coupled to an upper portion of the first control box.

18. The refrigerator as claimed in claim 17, further comprising an ejecting guide provided beyond the tray to guide the ice ejected out of the tray, an inner surface of the ejecting guide having a gentle curvature.

* * * * *